United States Patent [19]

MacEwen et al.

[11] 4,000,013

[45] Dec. 28, 1976

[54] METHOD OF TREATING ZR-BASE ALLOYS TO IMPROVE POST IRRADIATION DUCTILITY

[75] Inventors: Stuart R. MacEwen, Deep River; Craig J. Simpson, Bramalea, both of Canada

[73] Assignee: Atomic Energy of Canada Limited, Ottawa, Canada

[22] Filed: May 19, 1975

[21] Appl. No.: 579,001

[30] Foreign Application Priority Data

July 12, 1974 Canada ..... 204683

[52] U.S. Cl. ..... 148/11.5 F; 75/177; 148/133; 176/91 R

[51] Int. Cl.[2] ..... C22F 1/00

[58] Field of Search ..... 148/11.5 F, 133; 75/177

[56] References Cited

UNITED STATES PATENTS

| | | | |
|---|---|---|---|
| 3,287,111 | 11/1966 | Klepfer | 75/177 |
| 3,341,373 | 9/1967 | Evans | 148/11.5 F |
| 3,427,210 | 2/1969 | Varese | 148/11.5 F |
| 3,431,104 | 3/1969 | Klepfer | 75/177 |
| 3,567,522 | 3/1971 | Thomas et al. | 148/11.5 F |
| 3,645,800 | 2/1972 | Mock | 148/11.5 F |

*Primary Examiner*—Arthur J. Steiner
*Attorney, Agent, or Firm*—Francis W. Lemon

[57] ABSTRACT

A zirconium base alloy is produced, having improved ductility after irradiation with fast neutrons, by heating in a protective atmosphere a zirconium base alloy containing precipitates in the form of at least one alloying element (e.g. Nb, Mo, Ni or Cr), which is soluble with the zirconium in the $\beta$ phase and insoluble therewith in the $\alpha$ phase, until the precipitates have dissolved, water quenching the zirconium base alloy to produce a fine martensitic structure supersaturated with the or each alloying element, working the zirconium base alloy in steps reducing the cross-sectional area 10% to 20% of the original cross-section, with annealing below recrystallization temperature for at least 10 minutes in the $\alpha$ phase between steps, until a total reduction of 70%–75% of the original cross-section is achieved, and then annealing the zirconium base alloy so that simultaneous recrystallization and precipitation of the or each alloying element occurs. An alloy is produced having an average grain diameter of 0.1–0.5 microns which is particularly useful for nuclear fuel sheathing. An example of the procedure for a zirconium base niobium alloy is given.

4 Claims, 3 Drawing Figures

METHOD OF TREATING ZR-BASE ALLOYS TO IMPROVE POST IRRADIATION DUCTILITY

Figure 1:
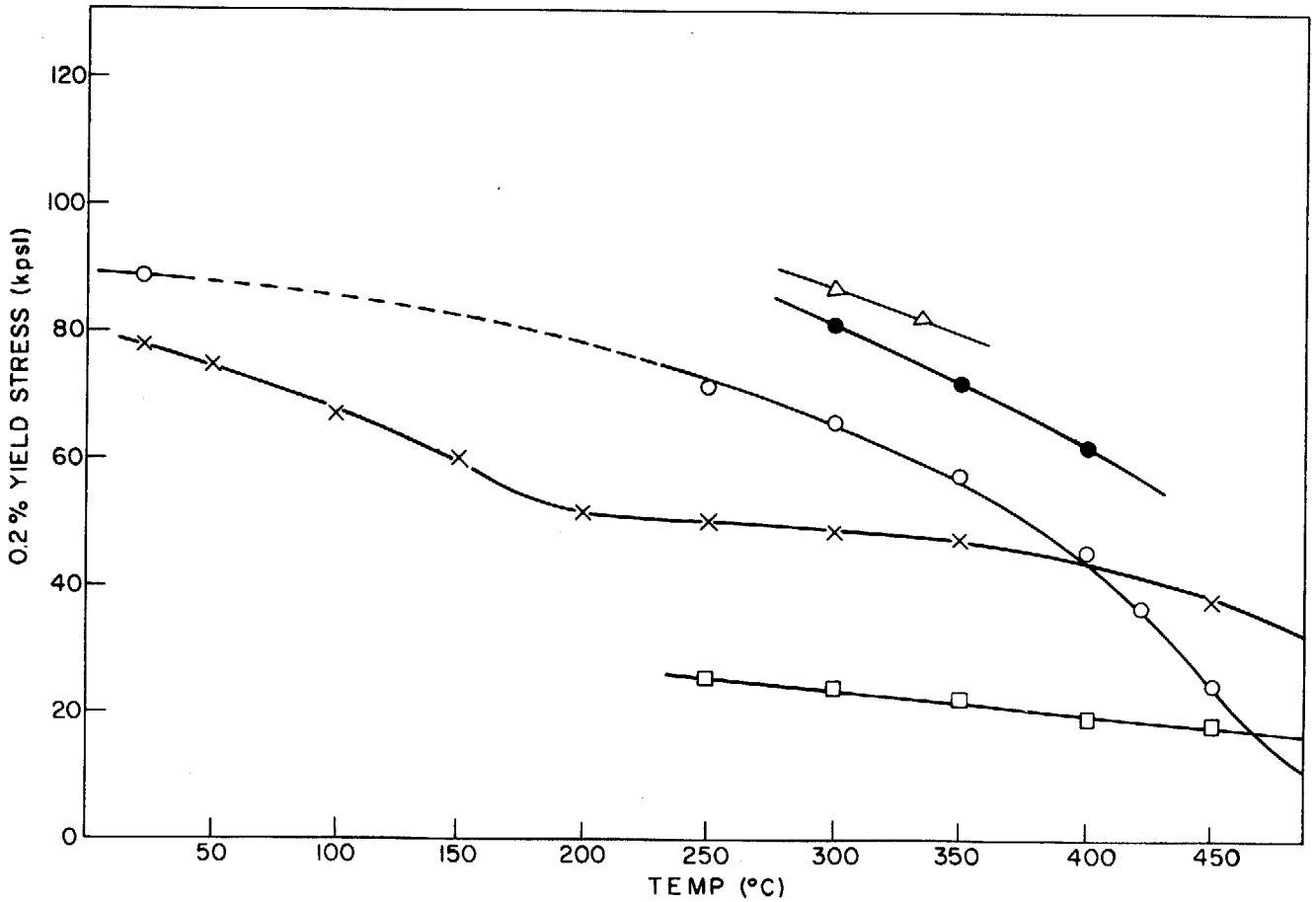

This invention relates to a method of producing a zirconium base alloy having improved ductility after irradiation with fast neutrons, and the alloy so produced.

There are many nuclear power reactors in operation which use nuclear fuel elements comprising, for example, nuclear fuel pellets sealed in a sheathing or tube of a zirconium base alloy. The zirconium base alloy fuel sheathing is usually exposed to a pressurized light or heavy water environment at a temperature of approximately 300° C. With the nuclear fuel elements operating at a temperature of approximately 300° C a thermal expansion of the nuclear fuel pellets has occurred, relative to the zirconium base alloy sheathing, which subjects the zirconium base alloy sheathing to stresses which are of sufficient magnitude to produce plastic yielding in the zirconium base alloy sheathing. The grain size of the conventional zirconium base alloys used for the sheathing is typically around 10 $\mu$m and these alloys rely on cold working during the manufacture of the sheathing for much of their yield strength.

When at a temperature in the region of 300° C, conventional zirconium base alloys deform by a dislocation glide mechanism, and after irradiation by fast neutrons to saturation levels these zirconium base alloys are found to have acquired a drastic loss in ductility because defect clusters, generated by the fast neutrons, interfere with the dislocation glide mechanism.

A further problem with a nuclear fuel sheathing is that the strain incurred therein, through thermal expansion and swelling of the nuclear fuel, is not uniform throughout the nuclear fuel sheathing. Localized strain in a nuclear fuel sheathing, at locations where a fuel pellet has cracked, can be up to one order of magnitude greater than the nominal maximum strain of 1% imposed by the thermal expansion of the nuclear fuel pellets when the nuclear reactor is operating at full power.

A further problem is that failure of a zirconium base alloy nuclear fuel sheathing results when the sheathing is cyclically stressed through alternate thermal expansion and contraction of the nuclear fuel pellets.

The mechanism of failure of a zirconium base alloy nuclear fuel sheathing is suspected to involve iodine stress-corrosion-cracking from iodine found as a fission product inside the zirconium base alloy nuclear fuel sheathing of a fuel element that has been utilized in a nuclear reactor. The above mentioned highly localized stress and lack of ability of an irradiated zirconium base alloy fuel sheathing to stress relax are contributing factors to this failure mechanism. It would therefore be desirable to provide a zirconium base niobium alloy having improved ductility and the ability to stress relax after irradiation with fast neutrons, and such an alloy would be particularly useful as a fuel sheathing for a nuclear fuel element.

It is an object of the present invention to provide a method of producing a zirconium base alloy having improved ductility and the ability to stress relax after irradiation with fast neutrons.

According to the present invention there is provided a method of producing a zirconium base alloy having improved ductility after irradiation with fast neutrons, comprising:

a. heating in a protective atmosphere a zirconium base alloy, containing precipitates of at least one alloying element which is substantially soluble with the zirconium base alloy in the $\beta$ phase and substantially insoluble therewith in the $\alpha$ phase, until the precipitates have dissolved in the zirconium base alloy;

b. terminating the heating by quenching the zirconium base alloy to produce a fine martensitic structure therein, supersaturated with the or each alloying element, then, c. working the zirconium base alloy in a plurality of working steps, each reducing the cross-sectional area thereof in the range 10% to 20% of the original cross-section, and between each working step, annealing the zirconium base alloy for at least ten minutes in the $\alpha$ phase and at a temperature below the recrystallization temperature, until a total reduction in the cross-sectional area in the range 70% to 75% of the original cross-section has occurred, and then d. annealing the zirconium base alloy at a temperature such that simultaneous recrystallization and precipitation occurs in the zirconium base alloy, and an alloy is produced having an average grain diameter in the range 0.1 to 0.5 microns.

Further according to the present invention there is provided a zirconium base niobium alloy having improved ductility at low strain rates after irradiation with fast neutrons, consisting of 2.40 to 2.80% by weight niobium, 900 to 13000 ppm oxygen, balance zirconium except for impurities, and wherein the average grain diameter is in the range 0.1 to 0.5 microns.

Any zirconium base alloy containing precipitates of at least one alloying element which is soluble in the zirconium base alloy in the $\beta$ phase and substantially insoluble therein in the $\alpha$ phase may be provided with the improved ductility according to the present invention. For example zirconium base alloys alloyed with at least one element selected from the group consisting of Mo, Cr, and Ni are suitable alloys. The alloy may consist solely of the zirconium base and niobium, except for impurities, as an example an alloy of Zr-2.5Nb has been found to be particularly useful, with the solute in the form of $\beta$ Nb.

The protective atmosphere in which the zirconium base alloy is initially heated until the precipitates have dissolved is preferably a vacuum atmosphere of at least about $10^{-5}$ torr, and preferably at least about $5 \times 10^{-6}$ torr. However, a gaseous atmosphere, such as an inert gas, for example, helium or argon, which have been treated to remove substantially all traces of deleterious substances such as oxygen, nitrogen, water vapour and hydrogen, may also be used.

Figure 2:
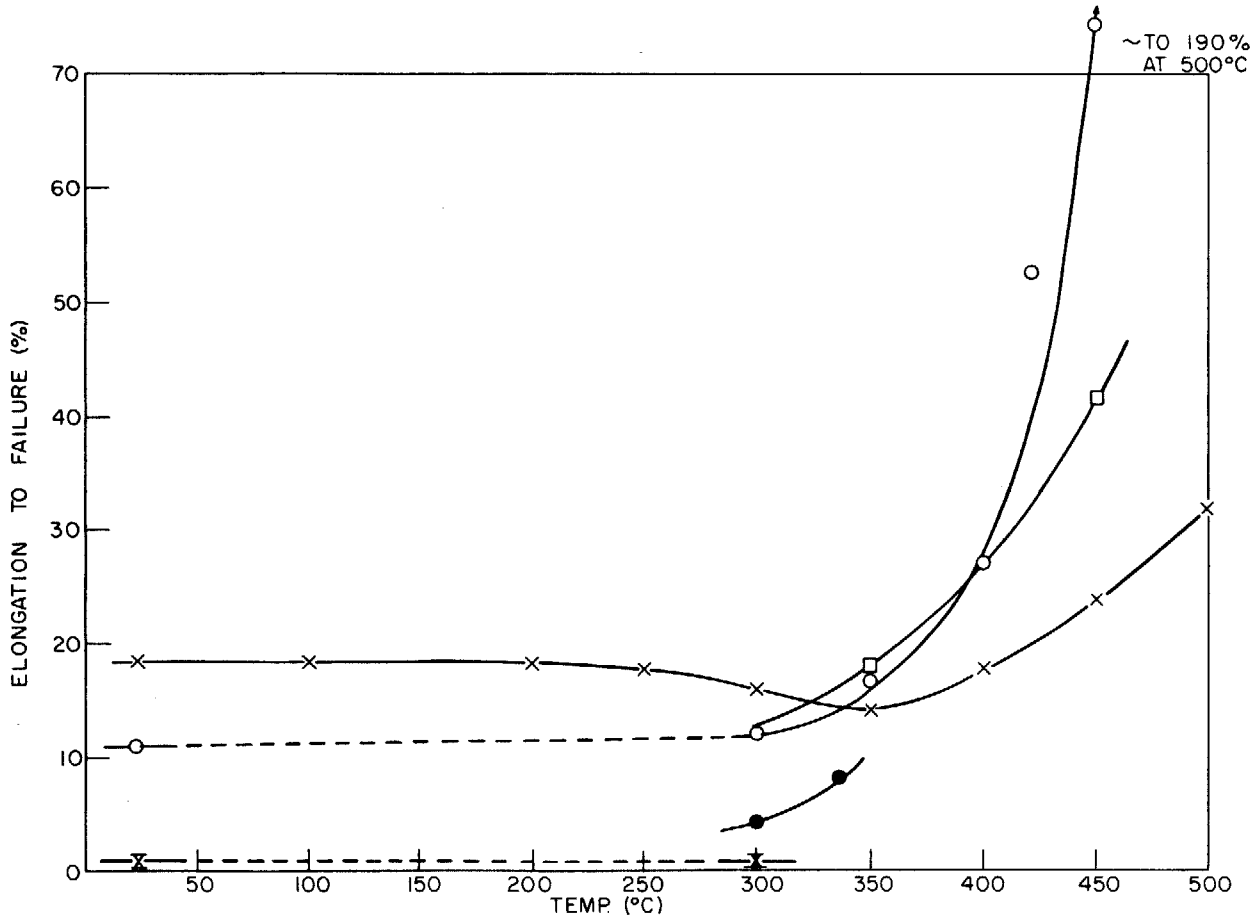
Figure 3:
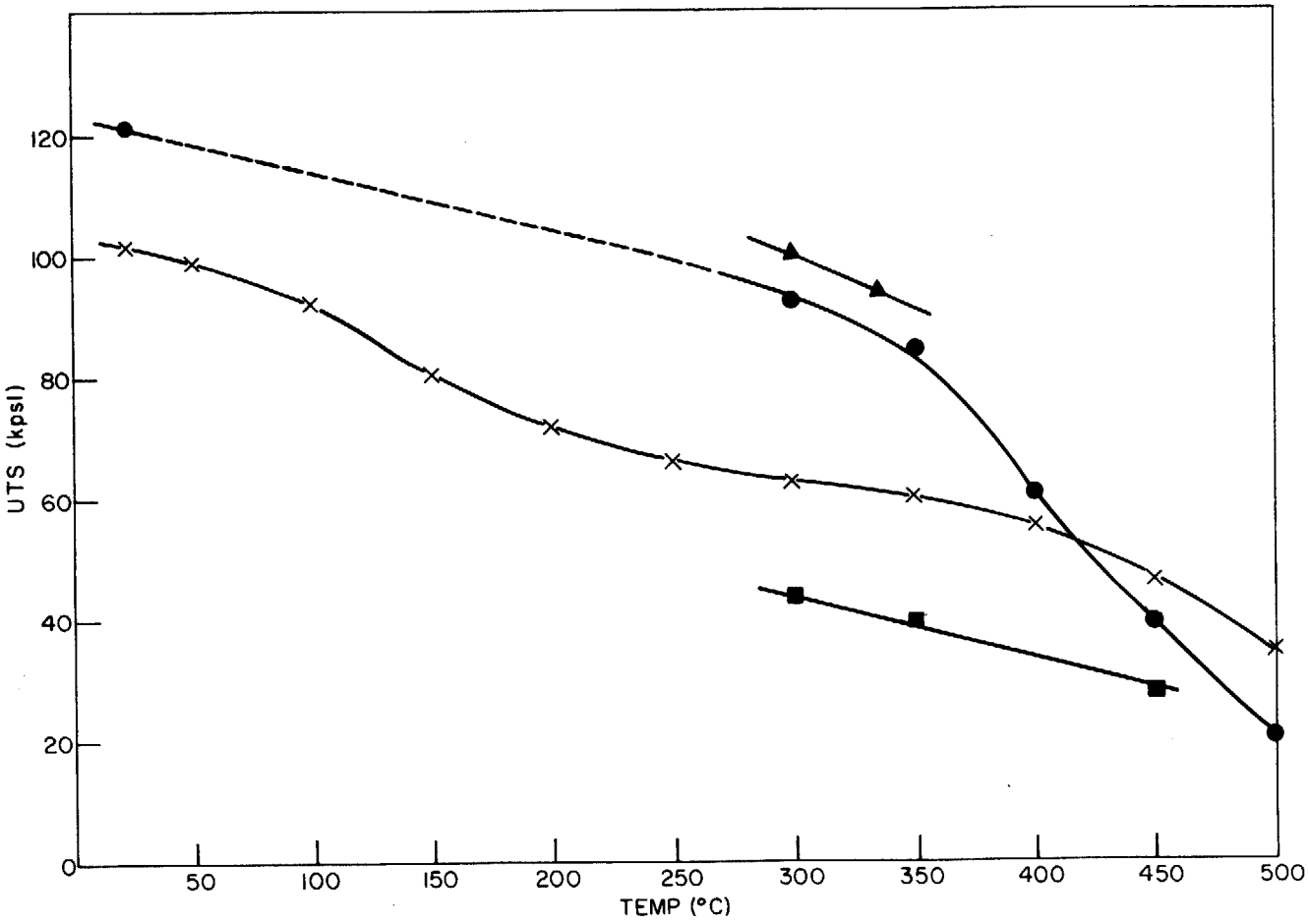

In the accompanying drawings, which show test results obtained on a 20000 lb floor model Instron (trade mark) Universal testing machine of an alloy according to the present invention and similar test results of known, comparable alloys, FIG. 1 is a graph showing yield stress versus temperature, FIG. 2 is a graph showing elongation failure versus temperature, and FIG. 3 is a graph showing ultimate tensile strength versus temperature.

As an example of the present invention, a 0.5 inch diameter bar stock of Zr-2.5% Nb alloy was heated in a vacuum atmosphere of at least $5 \times 10^{-6}$ torr at 950° C for a period of thirty minutes and then water quenched. At a temperature of 950° C the zirconium alloy was entirely a single phase body-centered-cubic structure, and the water quench produced an $\alpha$ martensite and the niobium, originally present in precipitate form in the alloy, is held in solution (non-equilibrium).

The water quenched martensite bar was then heavily worked to effect a reduction in cross-sectional area in the range 70% to 75% of the original cross-sectional area. This was achieved by heating the water quenched martensite bar in a furnace at 400° C for at least 10 minutes and then reducing the diameter by 0.050 inch in successive passes through a swage with reheating the bar in the furnace at 400° C for at least 10 minutes between each pass.

When the diameter of the bar had been reduced to 0.25 inch, that is reduced to 75% of the original cross-sectional area, the bar was finally annealed at 500° C for ten hours to produce a recrystallized average grain diameter in the order of 0.1 $\mu$m. This microstructure was found to be stabilized by $\beta$ niobium precipitates which nucleate and grow during the swaging and intermediate and final annealing operations.

In this specification a Zr-2.5% Nb alloy is an alloy comprising 2.40 to 2.80% by weight, 900 to 1300 ppm oxygen, balance zirconium except for impurities.

Specimens of Zr-2.5 Nb alloy produced by the above process and having a 0.15 micron grain size (hereinafter referred to as UFG) were produced by the above process and irradiated and compared with an irradiated Zr-2.5 Nb alloy having a 3 micron grain size (hereinafter referred to as CG) an irradiated conventional Zr-2.5 Nb alloy cold worked to a 40% to 60% reduction in cross-sectional area.

The tensile tests on irradiated UFG and unirradiated CG specimens were carried out in a temperature range of 250° C to 500° C and at a strain rate of $3.3 \times 10^{-5}$ $sec^{-1}$. The irradiated UFG was irradiated to a fluence of $5 \times 10^{18}$ n/cm$^2$ (E>1Mev):

In FIG. 1:

—▶— is the UFG irradiated and elongated at a strain rate of $3.3 \times 10^{-5}$ $sec^{-1}$ at elevated temperatures, —●— is the UFG unirradiated and elongated at a strain rate of $8.3 \times 10^{-4}$ $sec^{-1}$ at elevated temperatures, —○— is the UFG unirradiated and elongated at a strain rate of $3.3 \times 10^{-5}$ $sec^{-1}$ at elevated temperatures, —✕— is the conventional Zr-2.5 Nb alloy unirradiated and elongated at a strain rate of $3 \times 10^{-4}$ $sec^{-1}$ at elevated temperatures, and —□— is the CG unirradiated and elongated at a strain rate of $3.3 \times 10^{-5}$ $sec^{-1}$ at elevated temperatures.

In FIG. 2:

—○— is the UFG unirradiated and elongated at a strain rate of $3.3 \times 10^{-5}$ $sec^{-1}$ at elevated temperatures, —✕— is the conventional Zr-2.5 Nb alloy unirradiated and elongated at a strain rate of $3 \times 10^{-4}$ $sec^{-1}$ at elevated temperatures, —□— is the CG unirradiated and elongated at a strain rate of $3.3 \times 10^{-5}$ $sec^{-1}$ at elevated temperatures, —●— is the UFG irradiated and elongated at a strain rate of $3.3 \times 10^{-5}$ $sec^{-1}$ at elevated temperatures, and —✕— is the conventional Zr-2.5 Nb irradiated and elongated at a strain rate of $3 \times 10^{-4}$ $sec^{-1}$ at elevated temperatures.

In FIG. 3:

—▶— is the UFG irradiated and elongated at a strain rate of $3.3 \times 10^{-5}$ $sec^{-1}$ at elevated temperatures, —●— is the UFG unirradiated and elongated at a strain rate of $3.3 \times 10^{-5}$ $sec^{-1}$ at elevated temperatures, —✕— is the conventional Zr-2.5 Nb alloy unirradiated and elongated at a strain rate of $3 \times 10^{-4}$ $sec^{-1}$ at elevated temperatures, and —■— is the CG unirradiated and elongated at a strain rate of $3.3 \times 10^{-5}$ $sec^{-1}$ at elevated temperatures.

FIG. 1 shows that for temperatures below about 400° C the UFG material is greatly strengthened by the fine grain size. The effect of strain rate on the flow stress in UFG specimens is also given in FIG. 1. It can be seen that an increase in rate of 25 times produced an increase of nearly 30% in the flow stress at 300° C. For comparison, the flow stress-temperature curve of the conventional cold worked Zr-2.5 Nb alloy, pulled axially at a strain rate of approximately $3 \times 10^{-4}$ $sec^{-1}$, is shown. Such material shows little or no strain rate dependence in the range 250° – 450° C.

Even though annealed, UFG Zr-2.5 Nb has a much higher yield strength at 300° C, at both strain rates, than either CG or the conventional fuel alloy. Only for temperatures above 400° C does the UFG at the lower strain rate fall below the strength of conventional alloy (at the higher rate this may be increased to about 450° C). Above 400° C the 0.2% yield of UFG falls off rapidly as super-plastic behavior is approached. At 500° C a total of 190% elongation to failure was achieved, measured on a 0.100 in. diameter specimen with a 1 in. initial gauge length, as shown in FIG. 2. FIG. 2 compares the elongation to failure of UFG and conventional Zr-2.5 Nb alloy.

Another important feature is that the reduction of grain size in UFG has eliminated the decrease in ductility associated with strain ageing seen in conventional alloy between 250° and 400° C.

FIG. 3 plots the temperature dependence of the ultimate tensile strength for CG, UFG and the conventional alloy.

Of particular interest is the high strain rate and temperature dependence of the flow stress in UFG alloy. The conventional alloy and the CG deformed in the range 250° C to 500° C appear to be on an "athermal plateau". Thus a new deformation mechanism is definitely operative in the UFG. Although grain boundary sliding is suspected, the absence of strain ageing complicates interpretation of the results.

As shown in FIG. 2 two irradiated UFG specimens were tested for elongation failure. Tensile tests at 300° and 335° C at a strain rate of $3.3 \times 10^{-5}$ $sec^{-1}$ have shown that irradiation to a fluence of $5 \times 10^{18}$ n/cm$^2$ (E > Mev) has increased the 0.2% yield by approximately 23 kpsi. The elongation to failure was found to be approximately 4% at 300° C and 8% at 335° C, as shown in FIG. 2. These represent decreases of 66% and 47% due to irradiation damage. In contrast the elongation to failure of conventional Zr-2.5 Nb alloy is decreased by about 94% at 300° C. Ultimate tensile strengths of 100 kpsi and 95 kpsi were obtained at 300° and 335° C respectively, as shown in FIG. 3.

Stress relaxation tests were carried out on irradiated and unirradiated UFG at 300° C, irradiated UFG at 335° C and unirradiated CG at 300° C. As irradiated specimens of conventional cold-worked Zr-2.5 Nb alloy were not available for comparative tests, tests were done on specimens of the same composition but different microstructures. These specimens, hereinafter designated FC, had been furnace cooled after 1 hour at 800° C, resulting in a two phase mixture of $\alpha$ and $\beta$ Zr, with the $\beta$ phase containing up to 20% Nb. The grains were elongated, and were about 5 by 30 microns in size. A summary of results, and pertinent remarks, are given in the Table 1, below. Most remarkable is the ability of UFG material to stress relax, even after irradiation.

TABLE 1

| Material | Grain Size μm | Temp (° C) | Initiation of Relaxation Strain (%) | Initiation of Relaxation Stress kpsi | Relaxation 10 min kpsi | Relaxation 16 hrs kpsi | Remarks |
|---|---|---|---|---|---|---|---|
| CG | 3 | 300 | 4 | 43.3 | 3.35 | 8.85 | No initial yield point and no serrated flow. Transients after ε tests. Some strain ageing. |
| UFG | 0.15 | 300 | 0.05 | 63.0 | 5.50 | & — | No evidence of strain strain ageing. |
| " | " | " | 0.7 | 74.0 | 6.50 | & 18.1 | |
| Irradiated UFG | 0.15 | 300 | 0.05 | 84.2 | 3.62 | & — | No strain ageing yield points. Some evidence of serrations. |
| " | " | " | 1.2 | 98.7 | 6.50 | & 26.8 | |
| Irradiated UFG | 0.15 | 335 | 0.1 | 81.5 | 7.52 | & — | No evidence of strain ageing. No serrations. |
| " | " | " | 1.8 | 93.6 | 10.70 | & 34.4 | |
| FC | 5 × 30 | 300 | 0.3 | 30.0 | 2.95 | & — | Pronounced strain ageing and dynamic strain ageing. Large initial yield point, large serrations and transients after ε tests. |
| " | " | " | 1.0 | 29.1 | 2.05 | & 3.25 | |
| Irradiated FC | 5 × 30 | 300 | 0.3 | 40.0 | 0.53 | & — | No initial yield point. Slight evidence of strain ageing. |
| " | " | " | 1.0 | 44.6 | 0.80 | & 1.20 | |
| Irradiated FC | 5 × 30 | 335 | 0.2 | 39.4 | 0.25 | & — | No initial yield point. Transients after tests and serrated flow at high ($\epsilon = 2.4 \times 10^{-4}$ sec$^{-1}$) rate. |
| " | " | " | 1.5 | 48.1 | 1.25 | & 3.50 | |

Table 1 shows that irradiation damage decreases the amount of stress relaxation at short times (10 min.) for both UFG and the FC alloy, however the reduction is smaller in the UFG. At long times (16 Hours), at 300° C, unirradiated UFG relaxed approximately 25% of the applied stress; in the irradiated condition this increased slightly to 27%. In comparison, unirradiated FC alloy relaxed 11% of the applied stress in 16 hours at 300° C, and irradiation damage reduced the stress drop to only 2.7%.

Increasing temperature increases the amount of relaxation in both irradiated UFG and FC, but again the UFG relaxation behavior is clearly superior. At 335° C irradiated UFG relaxed 37% of the applied stress, whereas irradiated FC relaxed only 7% in the same time. (The above comparisons were made at strains ranging from 0.7 to 1.8%, and with a pre-strain rate of 3.3 $10^{-5}$ sec$^{-1}$).

The stress-relaxation experiments show that the UFG has the ability to deform plastically at very low strain rates even after irradiation.

We claim:

1. A method of producing a zirconium base alloy having improved ductility after irradiation with fast neutrons comprising:

a. heating in a protective atmosphere a zirconium base alloy, contaning precipitates of at least one alloying element, which is substantially soluble with the zirconium base alloy in the $\beta$ phase and substantially insoluble therewith in the $\alpha$ phase, until the precipitates have dissolved in the zirconium base alloy, b. terminating the heating by quenching the zirconium base alloy to produce a fine martensitic structure therein, supersaturated with the or each alloying element, then, c. working the zirconium base alloy in a plurality of working steps, each reducing the cross-sectional area thereof in the range 10% to 20% of the original cross-section, and between each working step, annealing the zirconium base alloy for at least ten minutes in the $\alpha$ phase and at a temperature below the recrystallization temperature, until a total reduction in the cross-sectional area in the range 70% to 75% of the original cross-section has occurred, and then d. annealing the zirconium base alloy at a temperature such that simultaneous recrystallization and precipitation occurs in the zirconium base alloys and an alloy is produced having an average grain diameter in the range 0.1 to 0.5 microns.

2. A method according to claim 1, wherein the zirconium base alloy consists of 2.40 to 2.80% by weight niobium, 900 to 1300 ppm oxygen, balance zirconium except for impurities.

3. A method according to claim 1, wherein the protective atmosphere is a vacuum atmosphere of at least $10^{-4}$ torr.

4. A method according to claim 1, wherein the zirconium base alloy is alloyed with at least one element selected from the group consisting of Nb, Mo, Cr, and Ni.

* * * * *